US005865550A

United States Patent [19]

Bouix

[11] Patent Number: 5,865,550

[45] Date of Patent: Feb. 2, 1999

[54] TAB-STYLE LOCKING MASS LIPSTICK CUP

[75] Inventor: Herve Francois Bouix, New York, N.Y.

[73] Assignee: E-L Management Corp., New York, N.Y.

[21] Appl. No.: 879,695

[22] Filed: Jun. 18, 1997

[51] Int. Cl.[6] ..... A45D 40/06

[52] U.S. Cl. ..... 401/88; 401/78; 401/86; 401/87

[58] Field of Search ..... 401/78, 86–88, 401/75, 68

[56] References Cited

U.S. PATENT DOCUMENTS

| | | | |
|---|---|---|---|
| 636,454 | 11/1899 | Rubira | 401/87 X |
| 1,557,608 | 10/1925 | Perkins | 401/88 |
| 3,150,770 | 9/1964 | Seaver | 401/87 |
| 3,175,680 | 3/1965 | Fuglsang-Madsen et al. | 401/78 |
| 3,214,012 | 10/1965 | Mack | 401/86 X |
| 4,579,134 | 4/1986 | Moore | 401/59 X |
| 4,820,070 | 4/1989 | Spatz | 401/87 |
| 5,560,727 | 10/1996 | Vaupel | 401/78 |

FOREIGN PATENT DOCUMENTS

| | | | |
|---|---|---|---|
| 3319031 | 11/1984 | Germany . | |
| 731013 | 6/1955 | United Kingdom . | |
| 2143212 | 2/1985 | United Kingdom | 401/78 |
| WO 96/32031 | 10/1996 | WIPO . | |

*Primary Examiner*—David J. Walczak
*Assistant Examiner*—Kathleen J. Prunner
*Attorney, Agent, or Firm*—Richard LaCava, Esq.

[57] ABSTRACT

The present invention is a holder cup for a stick-type product which comprises a hollow housing which is configured to receive a stick-type product. The hollow housing has a wall which contains at least one aperture. A tab capable of occupying a first open position or second locked position is pivotally mounted within an aperture. The tab has an outer cam surface which extends past the outside of the wall of the housing, and has a notch which fits the wall of the housing when the tab is in the second position. When the tab is caused to pivot toward the center of the holder cup the tab punctures the product and locks in place, thus preventing the release of the product from the holder cup.

8 Claims, 3 Drawing Sheets

TAB-STYLE LOCKING MASS LIPSTICK CUP

FIELD OF THE INVENTION

The present invention relates to a holder cup for a stick-type product that prevents the release of the stick-type product from the holder cup. More particularly, it concerns a holder cup which locks the stick-type product in place to prevent release of the stick-type product from the holder cup upon a shock to the case or upon shrinkage of the stick-type product itself.

BACKGROUND OF THE INVENTION

When stick-type products are placed into their respective cases they are held in place with a holder cup. The means by which the stick-type product is held in the cup is via a friction fit between the stick-type product and the inner wall of the holder cup. These two elements, the holder cup and the stick product, are dimensioned so that a proper friction fit is obtained. The problem with this means of holding the stick-type product in the holder cup is that, over time, the dimensions of the stick-type product will change, thereby causing the friction fit between the cup and the product to be insufficient to hold the product in place during a shock to the case. The dimensions of stick-type products change due to the method of cooling of the product after molding or filling into the holder cup whereby the cooling causes product to shrink.

Also, with the increasing use of volatile ingredients within the formulations for stick-type products, shrinkage problems are a concern. These volatile ingredients tend to evaporate, which then causes the product to shrink. When this happens, a once proper fit between the holder cup and the product will no longer be sufficient to hold the product in place. Once shrinkage has occurred to the point where the fit between the holder cup and the product is insufficient to hold the product in place, a small shock to the case will cause the product to release. Once the product has released from the holder cup it is virtually useless to the consumer.

Current holder cups try to remedy this problem in a number of different ways. Some cups provide a holder wall which protrudes from the bottom of the holder cup, so that when the stick-type product is inserted into the holder cup a greater surface area of contact between the product and the holder cup is provided (see German Patent No. 3319031). Along the same premise of increasing the contact surface area, longitudinally extending internal ribs are added to the holder cup as disclosed in U.S. Pat. No. 3,175,680 to Fuglsang-Madsen et al. and U.S. Pat. No. 4,579,134 to Moore. U.S. Pat. No. 4,820,070, provides that the longitudinally extending internal ribs be a dove-tail design to further provide greater contact area and to hold the stick in place after shrinkage of the stick has occurred.

With the new formulations of stick products that contain a considerable amount of volatile ingredients, it has been found that the frictional forces created by these configurations of holder cups is not sufficient to hold the product in place after shrinkage of the stick has occurred and then the case experiences a shock. This insufficient frictional force is created after the stick shrinks because holder cups of the longitudinal rib style pre-form a groove within the stick product when the stick is inserted into the holder cup. The product then shrinks away from the pre-formed groove thereby lessening the contact surface and the frictional forces.

WO Patent No. 96/32031 to Bennett provides for a holder cup that employs the use of a spike which penetrates a lipstick to hold the lipstick in place. This spike is either attached to a snap-ring or an arm. Both embodiments allow the spike to pass through an aperture in the holder cup, thereby puncturing a lipstick. This type of holder cup is effective in holding a stick product in place after shrinkage because a groove is not formed when the product is inserted into the holder cup. Though effective in holding a lipstick in place within a holder cup, these embodiments require additional assembly or may be difficult to manufacture via known holder cup molding techniques.

U.S. Pat. No. 5,560,727 to Vaupel, discloses the use of spring elements provided on the lipstick holder to aid in holding the lipstick mass in place. These spring elements are pressed into the lipstick as the lipstick holder is retracted into the case and form rear-engaging lugs. The disadvantage to this arrangement is that the rear-engaging lugs do not lock in place after they are pressed into the lipstick.

The purpose of the present invention is to provide a holder cup which will secure a stick-type product in place when the case is exposed to a shock.

Another purpose of the present invention is to provide a holder cup that is simple to manufacture.

Another purpose of this invention is to provide a holder cup which will continue to hold a stick-type product in place even after the product changes its dimensions.

Further, it is a purpose of this invention to provide a holder cup which can be used with existing case components with little or no modification to the case.

It is still a further purpose of this invention to provide a holder cup which is a relatively simple device that avoids interference with package aesthetics.

SUMMARY OF THE INVENTION

The present invention is a holder cup for a stick-type product, the cup comprising a hollow housing which is configured to receive a stick-type product, said hollow housing having a wall, the wall containing one or more apertures. A tab capable of occupying a first open position or second locked position is pivotally mounted within an aperture, said tab having an outer cam surface which extends past the outside of the wall of the housing, said cam surface having a notch which fits the wall of the housing when the tab is in the second position.

In order to secure the stick-type product within the holder cup, the product is first inserted into the housing. The product should be positioned in the housing so that the inserted end of the product is in a position below the tab. Next, the tab is caused to pivot toward the center of the holder cup by contact with a cam outside the housing. The tab then punctures the product and locks in place, thus preventing the release of the product.

BRIEF DESCRIPTION OF THE DRAWINGS

Further objects, features and drawings of the present invention will better be understood in light of the embodiment examples which are discussed below with the aid of a drawing wherein.

DETAILED DESCRIPTION OF THE INVENTION

Figure 1A:
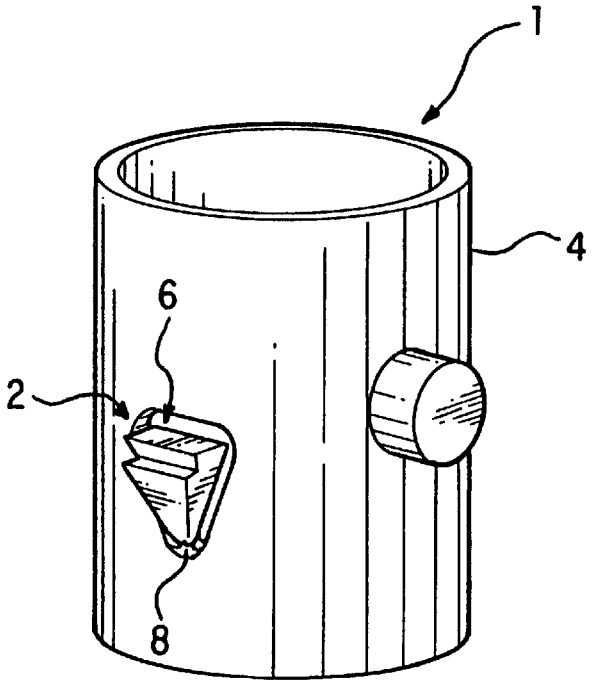
FIG. 1A is a perspective view of one embodiment of the tab and holder cup of the present invention.
Figure 1B:
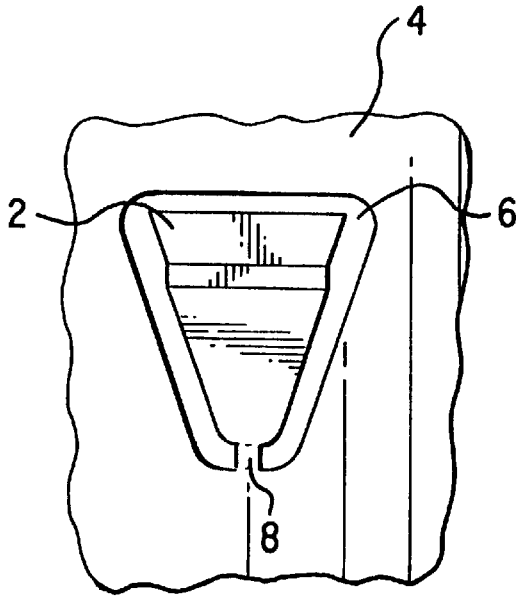
FIG. 1B is a front view of the tab depicted in FIG. 1A.
Figure 1C:
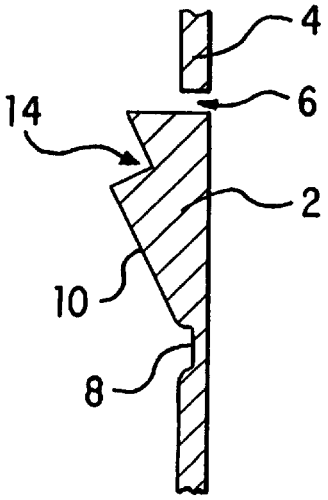
FIG. 1C is a cross-sectional view of the tab of FIG. 1A.
Figure 2A:
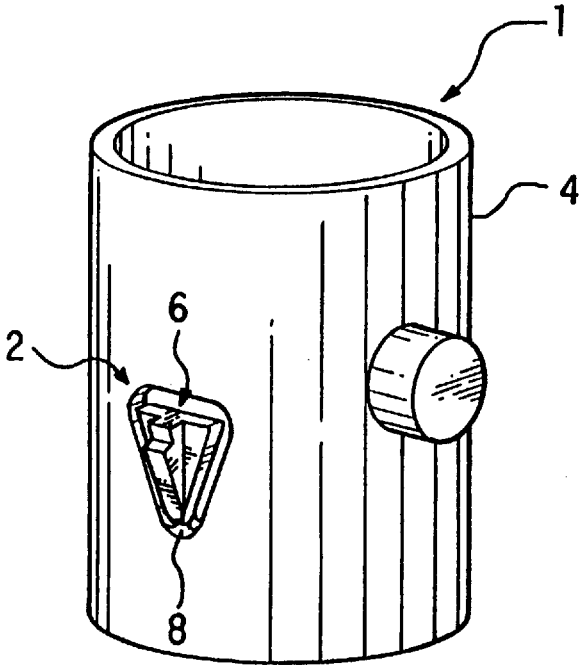
FIG. 2A is a perspective view of a different embodiment of the tab and holder cup of the present invention.
Figure 2B:
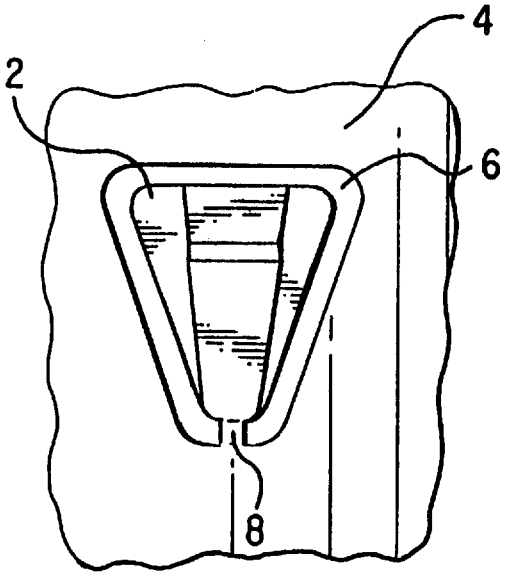
FIG. 2B is a front view of the tab depicted in FIG. 2A.
Figure 2C:
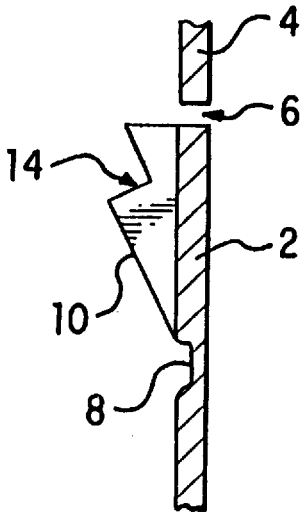
FIG. 2C is a cross-sectional view of the tab of FIG. 2A.

FIGS. 1A through 1C and FIGS. 2A through 2C show a holder cup 1 which prevents the release of a stick-type product 30 from the holder cup upon a shock to the case. This is accomplished through the use of tabs 2 which pierce the product 30 to hold it in place.

Holder cup 1 comprises a hollow housing 4 that is configured to receive a stick-type product 30. Hollow housing 4 contains one or more apertures 6 within the wall of housing 4.

A tab 2 is mounted in each aperture via a flexible member 8 which allows tab 2 to pivot between a first or a second position. When viewed from the side, the shape of tab 2 is generally a wedge shape wherein the outer surface of tab 2 extends past the outer wall of housing 4 to form a cam surface 10 which interacts with an external cam 12, thus allowing tab 2 to be pivoted at flexible member 8. Typically, external cam 12 will be disposed within a case that contains the holder cup. Tab 2 is mounted so that in a first position tab 2 is "open" and will not interfere with the product 30 as the product is inserted into housing 4, see FIGS. 1C, 2C, and 3A. Tab 2 is then pivoted to a second position through the interaction of cam surface 10 of tab 2 and external cam 12, wherein tab 2 punctures the product 30 and is "locked" in place, see FIG. 3B. The locking of tab 2 is accomplished through a notch 14 in cam surface 10 of tab 2 in which the wall of housing 4 fits when tab 2 is pivoted into the second position. The puncturing of the product 30 by tab 2 and the locking function act to prevent the release of the product from the holder cup. The edge of tab 2 that punctures the product 30 is dimensioned so as to allow tab 2 to penetrate the product 30 to a point sufficient to hold the product in place without fracturing or breaking the product. Typically, the edge of tab 2 will penetrate the product 30 for a distance of about 1.0 millimeters to about 3.0 millimeters.

Flexible member 8 should be sufficiently thin to allow tab 2 to pivot when pushed, and rigid enough to not allow tab 2 to pivot under its own weight. The dimensions of flexible member 8, in order to obtain the proper balance between the desired rigidity and flexibility, will be dependent on the material selected. The proper dimensions to use will be evident to one skilled in the art.

Common materials used in manufacturing stick product holder cups include polyethylene, polypropylene, acetal, polycarbonate, polyvinylchloride, polyethylene-terephthalate, acrylonitrile-butadiene-styrene, styrene-acrylonitrile, styrene, and the like. The choice of materials for the holder cup will be guided initially by compatibility with the intended stick product and ease of manufacture for the material chosen, such determinations being within the ordinary skill in the art.

In a preferred embodiment the holder cup is acetal. Acetal is a material that can easily be molded in a thickness which will impart a significant amount of flexibility and rigidity to the flexible member. Also, acetal provides a high degree of chemical resistance to many products.

The present invention, depending on the material selected, can be formed by a number of known processes. For example, when the holder cup is formed of a plastic material, a proper method of manufacture is injection molding. The use of injection molding as the preferred method for manufacturing the present invention allows the tab, the flexible member, and the housing to be formed as one integral unit. This reduces the cost of manufacture by eliminating any assembly costs that may be associated with multiple part holder cups that accomplish the same result.

For purposes of clarity the present invention will be described as used in conjunction with a lipstick. This example is merely illustrative, and in no way limits the present invention to lipstick. It will be apparent to one of ordinary skill in the art how the present disclosure can be adapted for use with any stick product, including, but not limited to, deodorants, lip balms, make-up foundations, clear cosmetic sticks, anti-acne sticks, antiperspirant, solid perfume, concealer, eyeshadow, blush, sunscreen, and the like.

The molding and assembly of a lipstick involves a number of steps. First, the molten mass of a lipstick is poured into a mold and allowed to cool. Second, a portion of the mold is removed whereby the base of the lipstick is exposed. Next, a pre-assembled lipstick case is provided.

This case is usually of the swivel-type which has the holder cup in the upper-most position within the case (i.e., the cup is in the position it would be in if the case contained a lipstick and that lipstick was swiveled to a position where the greatest amount of the lipstick would be exposed from the case). The case is placed so that the cup is aligned with the base of the lipstick, and then driven so that the base of the lipstick is forced into the cup. Finally, the cup is repelled into the case and a cover is placed over the case.

Figure 3A:
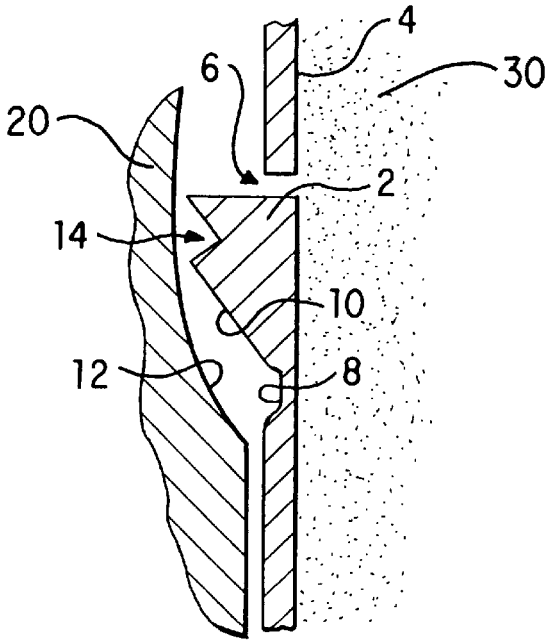
FIGS. 3A and 3B show the operation of the holder cup whereby the tab is displaced by a cam causing the tab to pierce the stick product and lock in place.
Figure 3B:
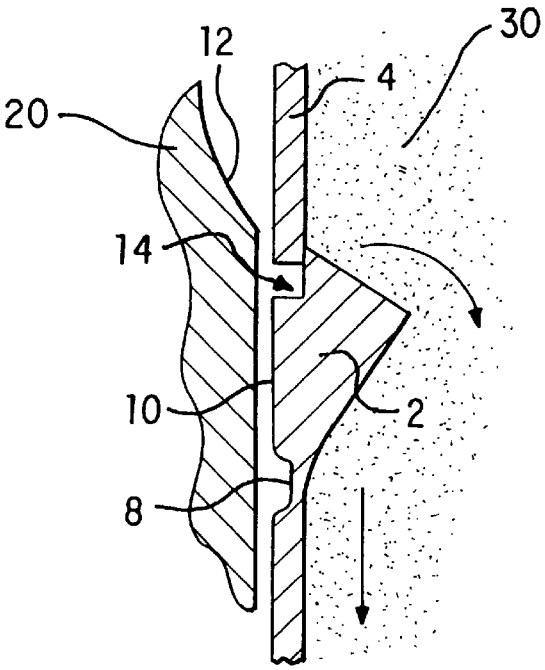

In a preferred embodiment the holder cup of the present invention is pre-assembled and placed into this swivel-type lipstick case. When this case is assembled, the cup is in the upper-most position within the case so that the cup can receive a lipstick. As seen in FIGS. 3A and 3B, while the cup is in this position, the case and tab 2 are fitted so that tab 2 will not interfere with the lipstick 30 as it is inserted into housing 4.

The lipstick 30 is then inserted into housing 4 to a point where the base of the lipstick 30 is in a position below tab 2. The insertion of the lipstick to this point is important, because if the lipstick is not inserted to at least this point, the lipstick will not be in a position where tab 2 can puncture the lipstick.

The inside of the case is provided with a cam 12 which interacts with cam surface 10 of tab 2. This interaction of cam 12 and cam surface 10 of tab 2 occurs as the holder cup is repelled into the case. It will be apparent to one of skill in the art of lipstick case manufacture that the material of cam 12 is one that is shaped and formed in such a way as to deform tab 2 inward. For example, in a swivel-type case cam 12 will be disposed on an inner sleeve 20 of the case. The shape of cam 12 can be that of a ledge or slope, which tab 2 will engage as the cup is repelled into the case. As tab 2 engages cam 12, tab 2 is pivoted towards the center of housing 4 causing tab 2 to lock in place after puncturing the lipstick 30.

In another embodiment, the holder cup is not pre-assembled into a lipstick case. In this embodiment the lipstick is molded in its usual fashion and the cup of the present invention will be placed over the base of the lipstick before the cup is pre-assembled into the case. After the cup is placed over the base of the lipstick tab 2 is then pivoted inwardly so that tab 2 locks in place and punctures the lipstick in the same manner as described above. The pivoting of tab 2 can be accomplished either manually with a finger or a sleeve can be placed over the cup so that the sides of the sleeve will act as a cam and engage cam surface 10 of tab 2. With the cup in place on the lipstick, the lipstick can then be removed from the mold and then placed within a case.

This embodiment of the present invention is especially useful with a disposable or refillable-type case, wherein the holder cup is configured so that it will be detachably secured within the case so that the holder cup and the stick product form a cartridge capable of being removed as a unit, thrown away, and replaced by a new unit. Refillable cases are such as described in British Patent No. 731,013, the contents of which are herein incorporated by reference. The modifications required to adapt the present invention for use within a refillable case would be apparent to one of ordinary skill in the art.

What we claim is:

1. A holder cup for a stick-type product, said holder cup comprising:

a hollow housing which is configured to receive the stick-type product, said hollow housing having a wall with an inner surface and an outer surface, the wall containing at least one aperture; and at least one tab capable of occupying a first open position or second locked position, each tab pivotally mounted within an aperture, said at least one tab having a cam surface which extends past the outer surface of the housing in the first position, said cam surface having a notch which fits the inner surface of the housing when the at least one tab is in the second position.

2. A holder cup for a stick-type product as in claim 1, wherein the stick type product is placed within the holder cup.

3. A holder cup for a stick-type product as in claim 2, wherein the tab has punctured the product and locked in place.

4. A holder cup for a stick-type product as in claim 2, wherein the product is a lipstick, lip balm, deodorant, antiperspirant, solid perfume, concealer, make-up foundation, eyeshadow, blush, acne treatment product, or sunscreen.

5. A holder cup for a stick-type product as in claim 1, wherein the holder cup is pre-assembled into a case.

6. A holder cup for a stick-type product as in claim 5, wherein the case comprises at least one cam disposed inside the case so as to align with the at least one tab on the hollow housing.

7. A case comprising:

a sleeve having at least one cam;

a holder cup disposed within the sleeve and containing a stick-type product, wherein the holder cup comprises:

a hollow housing, configured to receive the stick-type product, said housing having a wall with an inner surface and an outer surface, the wall containing at least one aperture; and at least one tab, each tab pivotally mounted within an aperture, the at least one tab having a cam surface with a notch, said cam surface interacting with the cam of the sleeve to lock the at least one tab into the wall of the housing.

8. A case according to claim 7, wherein the product is a lipstick, lip balm, deodorant, antiperspirant, solid perfume, concealer, make-up foundation, eyeshadow, blush, acne treatment product, or sunscreen.

* * * * *